United States Patent [19]

Fortino

[11] 4,011,847

[45] Mar. 15, 1977

[54] FUEL SUPPLY SYSTEM

[76] Inventor: Robert D. Fortino, Pinnacle Road, West Monroe, N.Y. 13167

[22] Filed: Aug. 23, 1974

[21] Appl. No.: 500,074

[52] U.S. Cl. ..... 123/134; 123/121; 261/121 R

[51] Int. Cl.[2] ..... F02M 17/22

[58] Field of Search ..... 123/133, 134, 25 E, 123/141, 121, 25 L; 261/121

[56] References Cited

UNITED STATES PATENTS

| | | | |
|---|---|---|---|
| 1,051,122 | 1/1913 | Krayer | 123/134 |
| 1,195,315 | 8/1916 | Williams | 123/134 |
| 2,381,304 | 8/1945 | Merrill | 123/121 |
| 2,430,852 | 11/1947 | Allen | 123/134 |
| 2,742,886 | 4/1956 | McPherson | 123/133 |
| 3,049,850 | 8/1962 | Smith | 123/134 |
| 3,395,681 | 8/1968 | Walker | 123/134 |
| 3,615,296 | 10/1971 | Guarneschelli | 123/141 |
| 3,749,376 | 7/1973 | Alm et al. | 123/134 |
| 3,800,533 | 4/1974 | Fankowski | 123/134 |

*Primary Examiner*—Ronald H. Lazarus
*Attorney, Agent, or Firm*—Charles S. McGuire

[57] ABSTRACT

A fuel supply system for internal combustion engines wherein a supply of liquid petroleum is vaporized primarily by atmospheric air from an outside source which is released below the liquid surface. The air may be pressurized by a compressor, or the like, or may be pulled through a direct, filtered intake by engine vacuum. In either case, it is released through holes in tubing below the liquid to rise to the top and be conducted directly to the carburetor or engine intake manifold. The usual liquid fuel line, with fuel pump and carburetor is also provided for selective use in place of the vaporization system.

4 Claims, 2 Drawing Figures

FUEL SUPPLY SYSTEM

BACKGROUND OF THE INVENTION

The present invention relates to fuel supply systems for internal combustion engines and, more particularly, to a dual, atomized liquid-vapor system for providing a fuel charge to the cylinders from a liquid petroleum fuel supply.

It is a principal object of the invention to provide a system for supplying a fuel charge to one or more cylinders of an internal combustion engine which provides a greater work output per unit of fuel consumed than conventional systems.

A further object is to provide a system for supplying a fuel charge from a supply of conventional liquid gasoline, or the like, to the combustion chamber of an engine optionally in either atomized or vaporized form.

Still another object is to provide a gas-saving attachment for an engine having a conventional carburetion system to allow operation with vaporized fuel under selected conditions.

Other objects will in part be obvious and will in part appear hereinafter.

SUMMARY OF THE INVENTION

In accordance with the foregoing objects, the invention is incorporated with conventional internal combustion engine apparatus having the usual cylinder block, carburetor and gas tank. Gasoline may be supplied through a fuel pump to the carburetor for mixture with air in a controlled manner to provide a fuel charge for combustion within the cylinder in the manner of virtually all present-day, commercial, gasoline-burning engines. In addition, the present invention provides means within the gas tank for introducing an air supply below the level of the liquid fuel therein.

An intake for atmospheric air is connected to an outlet in the lower part of an auxiliary tank which receives fuel as required from the gas tank. Preferably, the outlet comprises an elongated, hollow tube having a plurality of small openings so that the air is released to form bubbles in the liquid gasoline. As the bubbles rise to the surface and burst, the resulting vapor is heavily laden with petroleum molecules. A supply line for the vapor, in addition to the supply line for liquid fuel through the fuel pump, is provided to conduct the combustible vapor to the engine cylinders. Appropriate valving and mixture control means are provided as well as selectively actuable switch means for opening either the vapor or the liquid fuel supply line from the gas tank and closing the other line. In one embodiment, atmospheric air is provided directly through the intake to the gas tank by means of the partial vacuum created in the upper part of the tank by engine operation, and in a second embodiment a compressor is provided in the air intake line.

DETAILED DESCRIPTION

Figure 1:
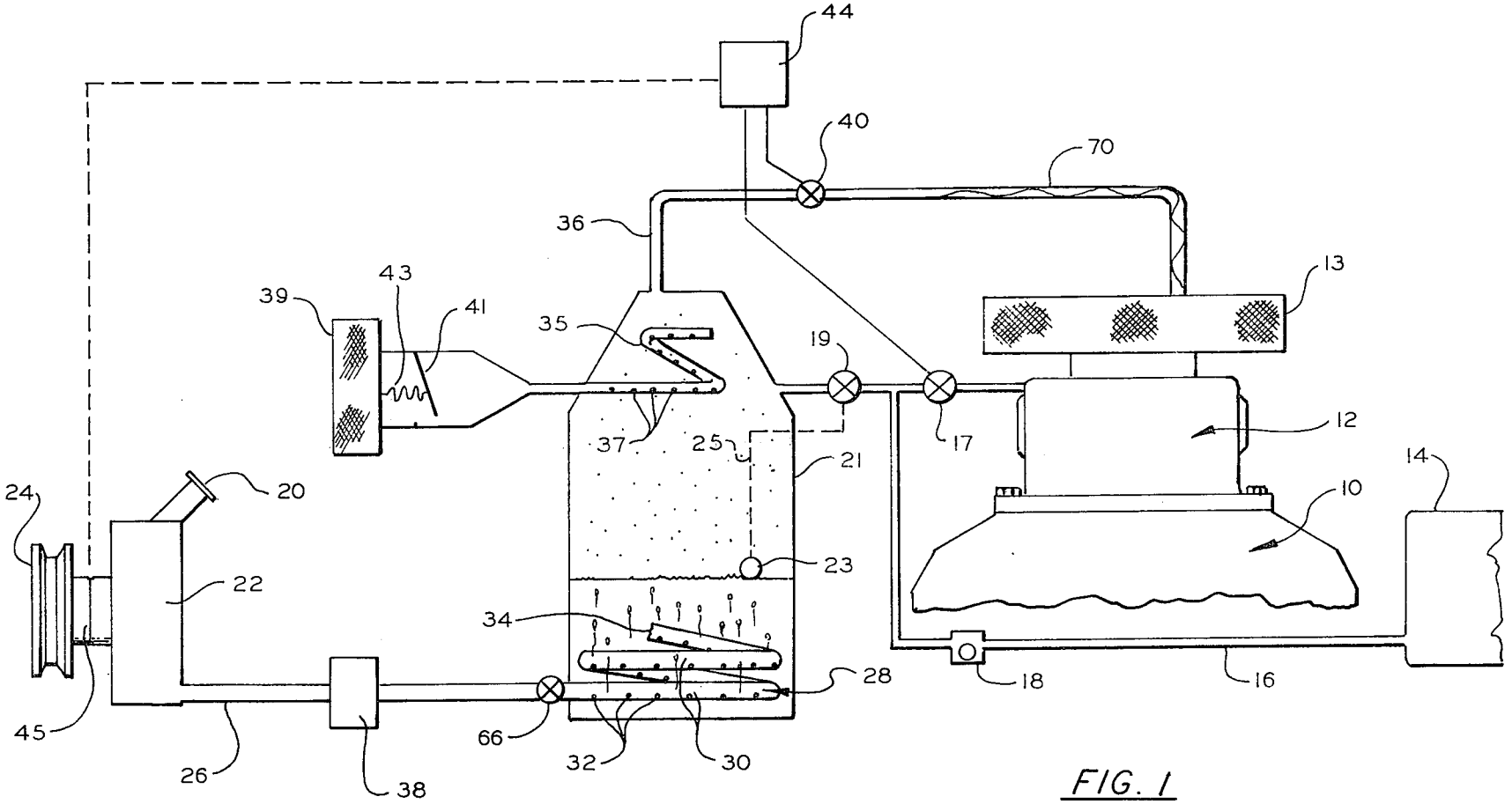
FIG. 1 is a diagrammatic illustration of an internal combustion engine system embodying a first form of the invention.

Referring now to the drawings, the reference numeral 10 indicates generally the cylinder block of a conventional, internal combustion engine having the usual pistons, cylinders, intake and exhaust manifolds and valves, cooling system, etc. Engine 10 may be of either the reciprocating or rotary type and has associated therewith carburetor 12, fitted with the usual air filter 13. A fragment of the conventional fuel tank is shown at 14, connected by line 16 to fuel pump 18, which operates in conventional fashion to provide a supply of liquid fuel from tank 14 to a T in line 16. Shut-off valves 17 and 19 are arranged in opposite branches and are opened and closed by control means described hereinafter. When valve 17 is open, fuel is supplied directly to carburetor 12, wherein the fuel is atomized and mixed with appropriate quantities of air to form a fuel charge suitable for combustion in engine 10 in purely conventional fashion. When valve 19 is open, fuel is supplied from fuel tank 14 to auxiliary tank 21, preferably at much smaller volume than tank 14.

Inlet line 20 conducts a supply of atmospheric air from outside the engine system to compressor 22. Pulley 24 is driven by a belt connection (not shown) to the output shaft of engine 10, or to other suitable drive means such as an electric motor. Compressor 22 is of conventional design, such as the well-known centrifugal or vane type of air compressors, and provides the air at a desired pressure in excess of atmospheric through line 26 to outlet means 28. In the FIG. 1 embodiment, outlet means 28 is the form of a continuous hollow tube 30 coiled within the lower portion of auxiliary tank 21. Tube 30 is an extension of line 26 for conducting air into tank 21 and includes a plurality of small openings 32 in its walls for release of the air within the tank. End 34 of tube 30 is closed so that all air from compressor 22 is released through openings 32, all or some of which are always below the level of liquid fuel within tank 21.

Float 23 is connected to valve 19, as schematically indicated by dotted line 25, to control opening and closing of this valve to maintain the liquid level in tank 21 within desired limits.

As the air is released through openings 32 it will form small bubbles within the liquid fuel which will rise to the surface and burst. Thus, the upper portion of tank 21, above the liquid level, will contain a vapor with a high concentration of fuel molecules. Line 36 provides communication between the upper end of tank 21 and engine 10, preferably through carburetor 12. Relief valve 38 is provided in conventional fashion in line 26 to prevent pressure in tank 21 from exceeding a predetermined maximum.

Valve 40 is provided in line 36 and is movable between fully open and closed positions, in the manner of valves 17 and 19, in response to actuation by control means 44, which also controls operation of valve 17. Control means 44 may comprise, for example, an electrical switch for actuating solenoid-type valves, the valves and control means being so constructed and arranged that each actuation of the control means serves to open one of valves 17 and 40 and close the other. Thus, fuel is supplied either to carburetor 12 in liquid form for atomization and supply to engine 10, or directly to engine 10 in vaporized form with control means 44 providing selection of either form of fuel supply. In applications where engine 10 is used to provide the drive power for a vehicle, control means 44 may include a manually operable switch accessible from the opertor's position.

Alternatively, control means 44 may be automatically actuated in response to other factors such as engine RPM or vehicle speed. For example, the control means may cause valve 17 to remain open with the liquid fuel supply line being active when the engine is started and at the relatively low speeds where more rapid accelleration is normally required. When the vehicle driven by engine 10 reaches a predetermined "cruising speed" control means 44 would automatically close valve 17 and open valve 40, whereby the fuel consumption rate would be significantly decreased.

An auxiliary air inlet means to tank 21, above the liquid level, is provided by hollow tube 35, having openings 37 and a closed end within tank 21. The inlet for tube 35 is preferably covered by filter 39, and one-way valve 41 is biased toward the closed position by spring 43 so that air enters only as required when the pressure in the upper portion of tank 21 falls below atmospheric.

Also shown in FIG. 1 is clutch 45, actuated by control means 44 to disconnect the pulley drive from compressor 22 when the liquid fuel line is operative. In this manner, air is released into tank 21 only when engine 10 is operating on vaporized fuel.

Figure 2:
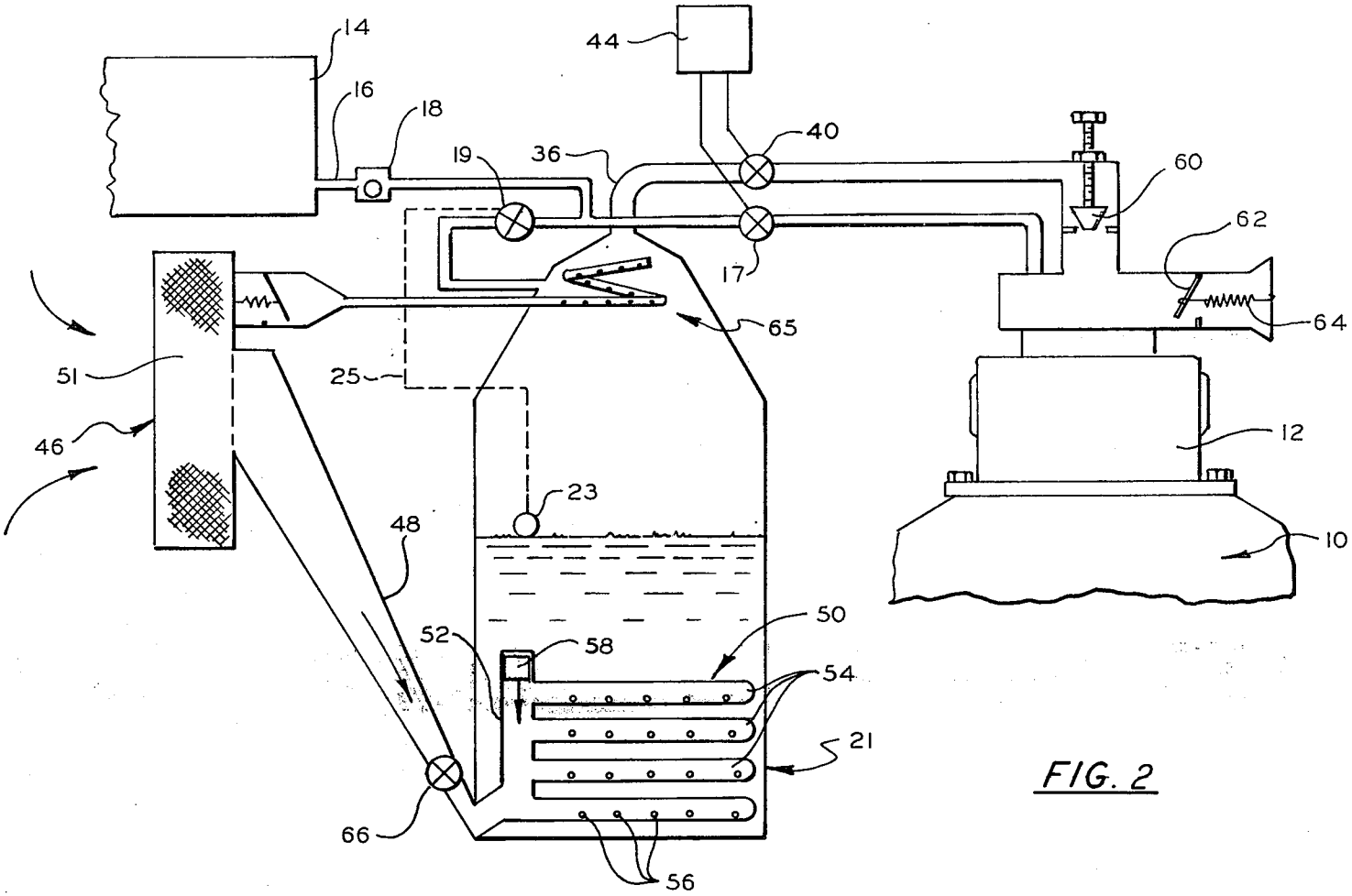
FIG. 2 is a diagrammatic illustration of a second embodiment of the invention.

A second embodiment is shown in FIG. 2 wherein common reference numerals are used for engine 10, carburetor 12, liquid fuel supply line 16, fuel tank 14, fuel pump 18, auxiliary tank 21, float 23, vaporized fuel supply line 36, valves 17, 19 and 40, and control means 44. In this embodiment the compressor is omitted, atmospheric air being supplied through intake 46 and line 48 to outlet means 50 within tank 21. Air filter 51 is associated with intake 46 and similar filter means may, of course, be incorporated in the air intake line of the FIG. 1 embodiment.

Outlet means 50 is of somewhat different form than outlet means 38, comprising an upright manifold tube 52 communicating with a plurality of outlet tubes 54 of any desired configuration at various levels within tank 21. Each of tubes 54 is closed at the outer end and includes a plurality of openings 56 for introducing air into the tank below the liquid fuel level. This embodiment permits the inclusion, if desired, of float-actuated valve means, diagrammatically indicated at 58, vertically movable within manifold tube 52 in accordance with the level of fuel in tank 21 to seal off the air supply to any of tubes 54 which may be above the fuel level. Thus, air is emitted only from the tubes below the liquid level, permitting a more stable concentration of fuel in the vapor in the event the liquid fuel level falls below that of some of tubes 54. Air will be drawn in through intake 46 in accordance with the partial vacuum created in the upper part of tank 16 when fuel vapor is drawn off through line 36, whereby air intake is on a demand basis and no valves, or the line, are required in inlet line 48. "Starve" valve 60 is adjustable to provide a desired intake rate for the fuel vapor entering carburetor 12, and flapper valve 62, having return spring 64, is provided in conventional fashion to permit air intake for mixture control.

As in the previous embodiment, auxiliary air inlet means 65 may be provided to allow additional intake in the event pressure within tank 21 falls below a predetermined minimum, controlled by the biasing force on valve 67. Intake to means 65 is directly through filter 51.

What is claimed is:

1. An internal combustion engine including a fuel supply system having a tank for liquid fuel and a line for supply thereof to a carburetor adapted to provide an atomized fuel charge to the engine cylinder for combustion therein, said system comprising:

a. an auxiliary tank containing liquid fuel;

b. first and second intake means for atmospheric air;

c. first and second outlet means communicating with said first and second intake means, respectively, and both arranged within said auxiliary tank for escape of the air from said first intake means below the level of liquid fuel and from said second intake means above the level of liquid fuel therein;

d. a vaporized fuel supply line connected between the upper side of said auxiliary tank and the carburetor of the engine, said vaporized fuel supply line including internal means for creating turbulance in the vapor flowing therethrough;

e. first and second valve means movable between fully open and closed positions and respectively arranged in the liquid and vaporized fuel supply lines; and f. control means actuable to move one of said valve means to the open position and the other of said valve means to the closed position alternately, with each successive actuation of said control means;

g. an air filter and an air intake valve associated with said second intake means, said intake valve being biased to a normally closed position and movable to an open position to admit air into the upper portion of said auxiliary tank in response to pressure therein falling below atmosphere.

2. The invention according to claim 1 and further including compressor means for providing air to said first outlet means at higher than atmospheric pressure.

3. The invention according to claim 2 and further including means for deactuating said compressor means in response to movement of the one of said valve means in said vaporized fuel supply line to the closed position.

4. The invention according to claim 1 wherein both said outlet means comprises a length of hollow tubing communicating with said intake means and having a plurlity of openings along the length thereof.

* * * * *